US009270015B2

(12) United States Patent
Harper

(10) Patent No.: US 9,270,015 B2
(45) Date of Patent: Feb. 23, 2016

(54) ATTACHMENT COMPONENT WITH PARASITIC ANTENNA

(71) Applicant: Microsoft Corporation, Redmond, WA (US)

(72) Inventor: Marc Harper, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 96 days.

(21) Appl. No.: 14/201,486

(22) Filed: Mar. 7, 2014

(65) Prior Publication Data

US 2015/0255859 A1 Sep. 10, 2015

(51) Int. Cl.

| | |
|---|---|
| ***H01Q 1/27*** | (2006.01) |
| ***H01Q 19/00*** | (2006.01) |
| ***H01Q 1/22*** | (2006.01) |
| ***H01Q 1/44*** | (2006.01) |

(52) U.S. Cl.

CPC ..... *H01Q 1/273* (2013.01); *H01Q 1/22* (2013.01); *H01Q 1/44* (2013.01); *H01Q 19/005* (2013.01)

(58) Field of Classification Search

CPC ..... H01Q 1/273; H01Q 19/005
USPC ..... 343/718, 702
See application file for complete search history.

(56) References Cited

U.S. PATENT DOCUMENTS

| | | | | |
|---|---|---|---|---|
| 6,262,684 | B1 * | 7/2001 | Stewart et al. | 343/702 |
| 6,275,193 | B1 * | 8/2001 | Nilsen et al. | 343/702 |
| 6,665,543 | B1 * | 12/2003 | McCleary et al. | 343/723 |
| 7,656,355 | B2 * | 2/2010 | Hsin | 343/702 |
| 7,834,863 | B2 * | 11/2010 | Lee | 345/179 |
| 8,922,527 | B2 * | 12/2014 | Ryshtun et al. | 345/175 |
| 2008/0226381 | A1 | 9/2008 | Chiu | |
| 2013/0207938 | A1 | 8/2013 | Ryshtun et al. | |
| 2013/0234998 | A1 | 9/2013 | Wang et al. | |
| 2013/0321355 | A1 | 12/2013 | Teiblum | |

FOREIGN PATENT DOCUMENTS

WO 2010128942 A1 11/2010

* cited by examiner

*Primary Examiner* — Brian Young
(74) *Attorney, Agent, or Firm* — Judy Yee; Jeremy Snodgrass; Micky Minhas

(57) ABSTRACT

A wearable electronic device includes an active antenna and an attachment component for attaching the wearable electronic device to a wearer. The attachment component includes a floating portion adapted to resonate in the presence of a radio frequency (RF) carrier wave transmitted by the active antenna. The floating portion is positioned relative to the active antenna to achieve a target coupling with the transmitted RF carrier wave.

22 Claims, 4 Drawing Sheets

ATTACHMENT COMPONENT WITH PARASITIC ANTENNA

BACKGROUND

Antennas for computing devices present challenges relating to receiving and transmitting radio waves. These challenges are magnified by the trend to produce increasingly smaller wireless electronic devices with adequate transmission power. Antenna size can affect antenna power, constraining a number of available design options.

SUMMARY

Implementations described and claimed herein address the foregoing by providing an attachment component attaching a wearable electronic device to a wearer. The attachment component includes a parasitic antenna adapted to resonate in the presence of a carrier wave transmitted by an active antenna of the wearable electronic device.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Figure 1:
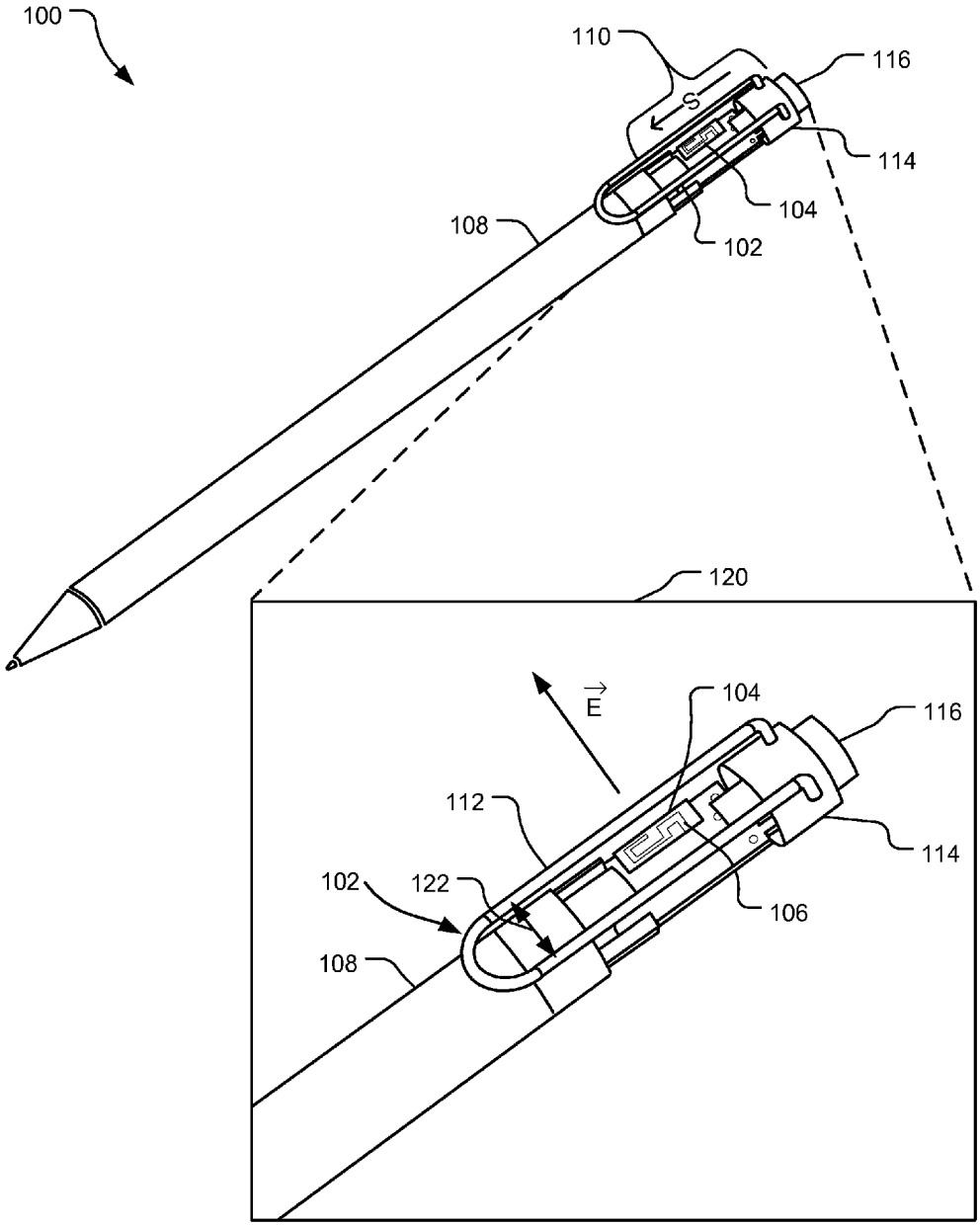
FIG. 1 illustrates an example wearable electronic device having an attachment component including a parasitic antenna.

FIG. 1 illustrates an example wearable electronic device 100 having an attachment component 102 including a parasitic antenna 112. The wearable electronic device 100 is shown to be a stylus or pen, but may be any electronic device that includes wireless communications circuitry for transmission of a radio frequency (RF) carrier wave. Examples of other types of wearable electronic devices that may make use of the disclosed technology include without limitation jewelry, watches, glasses, stylus holders, and other portable computing accessories. Because the attachment component 102 provides for convenient transport and storage of the wearable electronic device 100, the disclosed technology may be of particular use when incorporated into electronic devices that can be attached to clothing, luggage, purses, transportation apparatus (e.g., bikes, cars, etc.), or other readily transportable articles.

The wearable electronic device 100 includes a printed circuit board (PCB) 104 including an active antenna 106. The active antenna 106 is shown to be internal to the wearable electronic device 100 but may, in other implementations, be attached to or form an external surface of the wearable electronic device 100. The active antenna 106 is electrically coupled to a radio (not shown) and capable of transmitting an RF carrier wave.

The parasitic antenna 112 forms a portion of the attachment component 102, and is sized, positioned, and oriented to resonate at a target frequency. In FIG. 1, the attachment component 102 is a clip that resonates at the target frequency. In this case, the attachment component 102 and the parasitic antenna 112 include substantially the same subcomponents. In other implementations, the parasitic antenna 112 forms a portion of the attachment component 102. For example, the attachment component 102 may be a bracelet with an ornamental detail that acts as the parasitic antenna 112. The attachment component 102 may be flexible and may include a parasitic antenna that is flexible. For example, the attachment component 102 may be a polymer watch band that includes a flexible parasitic antenna embedded in the watch band. A variety of other implementations are also contemplated.

When the active antenna 106 is placed into a transmission mode, such as by pressing an on/off button 116, the active antenna 106 transmits an RF carrier wave oscillating at the target frequency. The RF carrier wave excites the parasitic antenna 112 into a state of resonance. On/off button 116 may be used to trigger various commands, actions, or behaviors in wearable electronic device 100 and/or in other devices that are in wireless communication with wearable electronic device 100. For example, on/off button 116 may be used to trigger wearable electronic device 100 to send a wake-up command to a tablet device. Active antenna 106 and parasitic antenna 112 may facilitate sending the wake-up command via an RF carrier wave. The tablet device may then enter into a wake-up state, thereby enabling a user of wearable electronic device 100 to interact with the tablet device. For example, if wearable electronic device 100 is a stylus, a user may press on/off button 116 to wake-up a tablet device, and then start writing on the tablet device with the stylus.

The wearable electronic device 100 is shown in an extended position with an upper portion 110 pulled out of an outer casing 108 of the wearable electronic device 100. The upper portion 110 is adapted to slide in a direction indicated by an arrow S so that the PCB 104 is, during use, positioned partially or entirely within the outer casing 108. The outer casing 108 is an insulating structure (e.g., plastic), while the parasitic antenna 112 is a conductive material (e.g., metal or ceramic) that is not grounded, either within a capping portion 114 of the outer casing 108 or elsewhere in the wearable electronic device 100. Because it is not grounded, the parasitic antenna 112 is also described as a "floating" component or portion of the attachment component 102.

In FIG. 1, the external parasitic antenna 112 is a u-shaped wire structure lying within a plane substantially parallel to the outer casing 108. A lower end of the u-shaped wire structure includes a bent portion of the "u-shape." An opposite, upper end of the u-shaped wire structure includes free ends of the wire "u-shape" that attaches to a capping portion 114 of the outer casing 108.

The wearable electronic device 100 may be attached to a wearer or other body by engaging the attachment component 102. In FIG. 1, the attachment component 102 is a clip that can be engaged by sliding a portion of an article between the attachment component 102 and the outer casing 108. For example, material of a wearer's pocket may be positioned between the u-shaped wire clip and the outer casing 108 to attach the wearable electronic device 100 to the wearer's shirt. In other implementations, the attachment component 102 is securable by means other than clipping. For example, the attachment component 102 may be secured to a wearer or other body by way of a hinge, nut-in-bolt fastener, threaded screw, clamp, latch, button, zipper, snap, Velcro flap, adhesive, etc. A variety of other implementations are also contemplated.

The parasitic antenna 112 may take a variety of different shapes and sizes depending on both functional (electrical function and mechanical function) and non-functional (e.g., aesthetic) design criteria. In at least one implementation, the parasitic antenna 112 is a solid, planar component rather than a u-shaped wire. In another implementation, the parasitic antenna 112 is a bent or twisted wire. In another implementation, the parasitic antenna 112 is a wire including a series of loops. Other implementations are also contemplated.

When excited into a state of resonance by the RF carrier wave transmitted by the active antenna 106, the parasitic antenna 112 effectively re-transmits the RF wave at a higher transmission power. Consequently, the transmitted RF carrier wave is readily detectable by a receiving antenna affixed to another nearby electronic device, such as a laptop computer or other mobile device that may process data of the RF carrier wave. In one implementation, the active antenna 106 is an active monopole antenna that radiates a short wavelength RF carrier wave in the ISM band from 2.4 to 2.485 GHz (e.g., a range used by Bluetooth devices that exchange data over short distances).

During transmission of the RF carrier wave, an inductance forms along the length of the u-shaped wire structure, a capacitance forms between the parallel lengths of wire forming opposite sides of the u-shaped wire structure, and a mutual inductance forms between the two opposite sides of the u-shaped wire. These capacitance and inductance values determine a resonant frequency of the external parasitic antenna 112. Accordingly, a distance 122 between the parallel lengths of wire can be altered to vary this capacitance and alter a resonant frequency of the parasitic antenna 112. For example, positioning the parallel lengths of wire closer together may cause the external parasitic antenna 112 to resonate at a lower frequency.

In FIG. 1, a direction of an RF carrier wave generated by the active antenna 106 is indicated by the electric field $\vec{E}$ and corresponding arrow. The electric field $\vec{E}$ is in a direction substantially parallel to a plane of the external parasitic antenna 112 (e.g., parallel to a plane drawn through a line indicating the distance 122). Thus, an angle between the external parasitic antenna 112 and the electric field of the RF carrier wave generated by the active antenna 106 is effectively 0 degrees.

According to one implementation, the efficiency of the external parasitic antenna 112 is highest when the angle between the parasitic antenna 112 and the electric field generated by the active antenna 106 is effectively 0 degrees (as shown). As the external parasitic antenna 112 is rotated relative to the PCB 104, the efficiency of the external parasitic antenna 112 decreases and the resonant frequency is altered.

In one implementation, the orientation of the parasitic antenna 112 is fixed relative to the PCB 104 to ensure a maximum efficiency of transmission at the target resonant frequency of the external parasitic antenna 112. In another implementation, the parasitic antenna 112 is rotatable to allow for resonance at multiple different frequencies. For example, the wearable electronic device 100 may have two different active antennas that each transmits an RF carrier wave at a different frequency. A user may rotate the external parasitic antenna 112 between first and second positions to select one of the two transmission frequencies. In one such implementation, each of the active antennas has an on/off switch associated with a different position of the parasitic antenna 112. For example, a user may turn off a first active antenna by rotating the parasitic antenna 112 away from a first fixed position and turn on a second antenna by halting the rotation at a second fixed position.

In another implementation, the capping portion 114 includes passive circuitry to adjust the resonant frequency of the parasitic antenna 112. For example, one or more capacitors or inductors may be included in the capping structure 114 and electrically coupled to the parasitic antenna 112. The passive circuitry can be used to raise or lower the resonant frequency of the parasitic antenna 112 and also may provide impedance matching between the active antenna 106 and the parasitic antenna 112.

Figure 2:
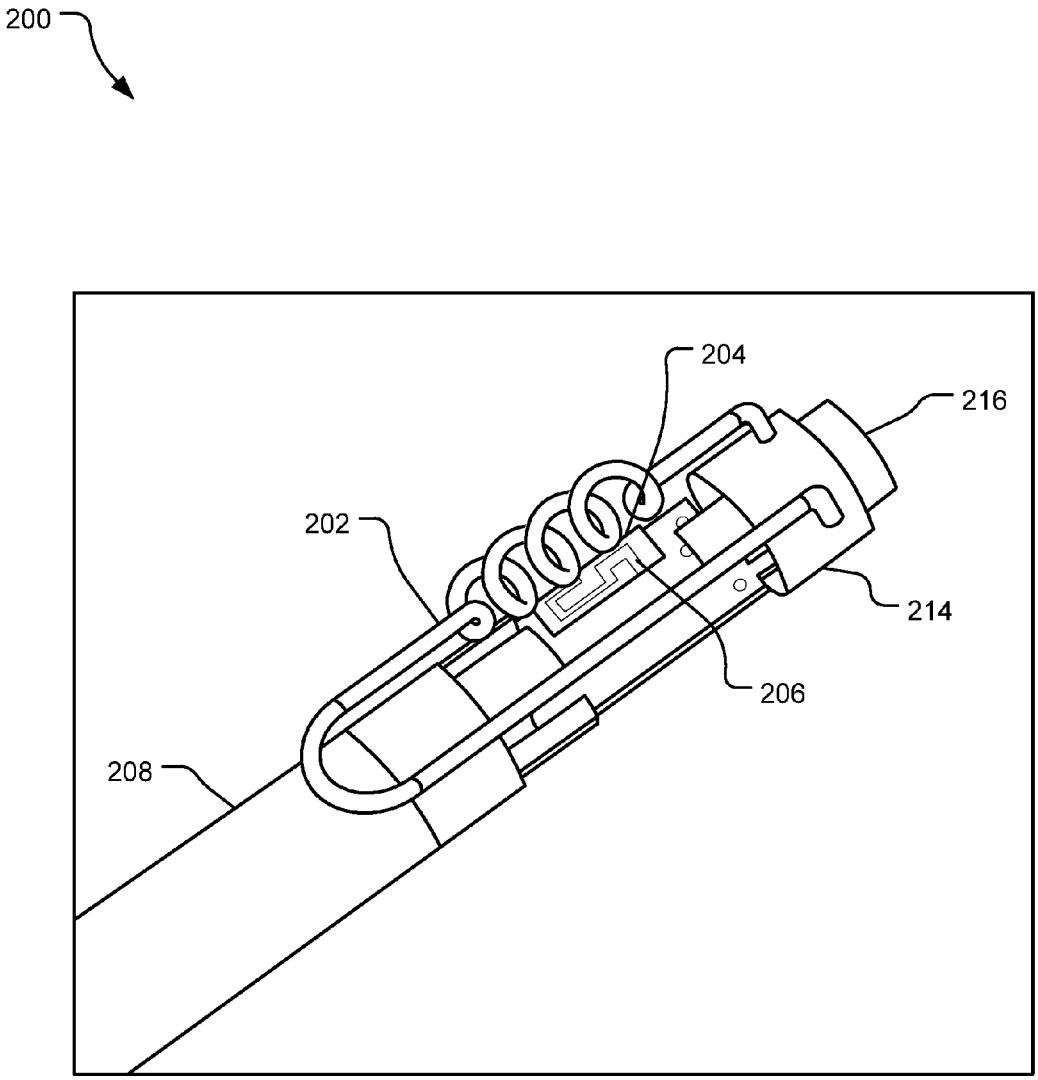
FIG. 2 illustrates a stylus having an attachment component including a parasitic antenna.

FIG. 2 illustrates a portion of a stylus 200 having a parasitic antenna 202 that functions as an attachment component (e.g., a clip). The external parasitic antenna 202 is a u-shaped metal structure that is sized, shaped, and positioned to resonate at a target frequency that matches a transmission frequency of an active antenna 206. In other implementations, the attachment component includes some components that are not part of the parasitic antenna 202. Thus, the parasitic antenna 202 may form a portion of an attachment component rather than an entire attachment component.

The active antenna 206 is shown internal to an outer casing 208 the stylus 200, but in other implementations is external to the outer casing 208. The active antenna 206 is mounted on a PCB 204 housed within an outer casing 208 of the stylus 200. When the active antenna 206 is placed into a transmission mode, such as by pressing an on/off button 216, the active antenna 206 transmits an RF carrier wave that excites the parasitic antenna 202 into a state of resonance.

The parasitic antenna 202 is a floating (e.g., non-grounded) structure that may also be used to attach the stylus 200 to an article, such as a strap, pocket, etc. In FIG. 2, the parasitic antenna 202 includes a coil region 214 that supplies an inductance and affects a resonant frequency of the parasitic antenna 202. For example, the coiled region 214 may lower the resonant frequency of the parasitic antenna 202.

Figure 3:
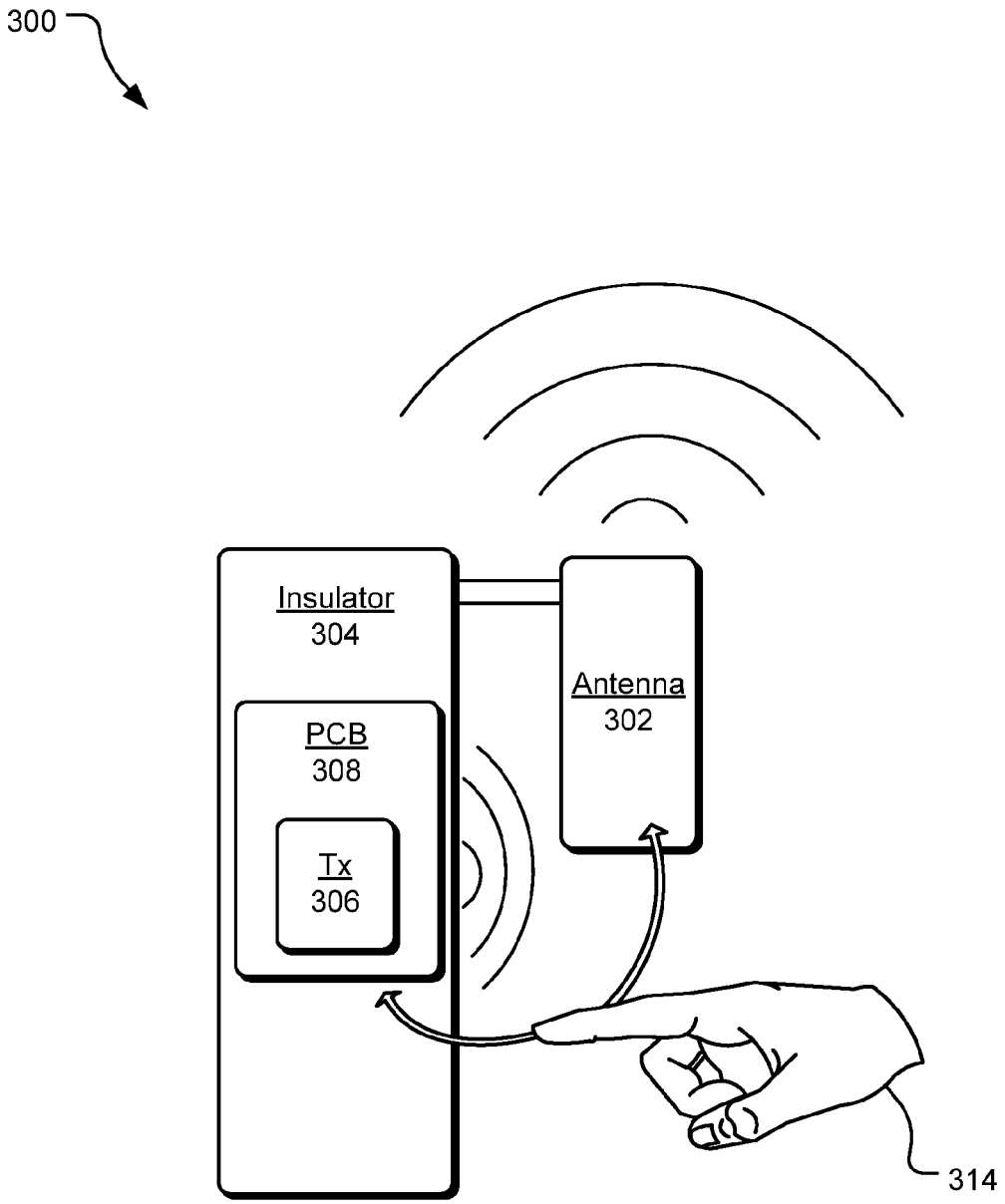
FIG. 3 illustrates example electrical components and data flows for a wearable electronic device with a wireless transmission capability and an attachment component including a parasitic antenna.

FIG. 3 illustrates example electrical components and data flows for a wearable electronic device 300 with a wireless transmission capability and a parasitic antenna 302. The wearable electronic device 300 includes an active antenna 306 (e.g., a monopole antenna) coupled to a radio via a feed structure on a PCB 308 within the wearable electronic device 300. The PCB 308 is encased in an insulating structure 304 and electrically separated from the parasitic antenna 302. In other implementations, multiple antennas configured to support MIMO telecommunications or multiple types of telecommunications specifications (e.g., Bluetooth, IEEE 802.11, and LTE) may be located on PCB 308.

The parasitic antenna 302 is a floating structure that is sized, positioned, and oriented to resonate at a target frequency matching a transmission frequency of the active antenna 306. The parasitic antenna 302 also forms a portion of an attachment component for attaching the wearable electronic device 300 to an article or other body, such as an article of clothing of a wearer.

Figure 4:
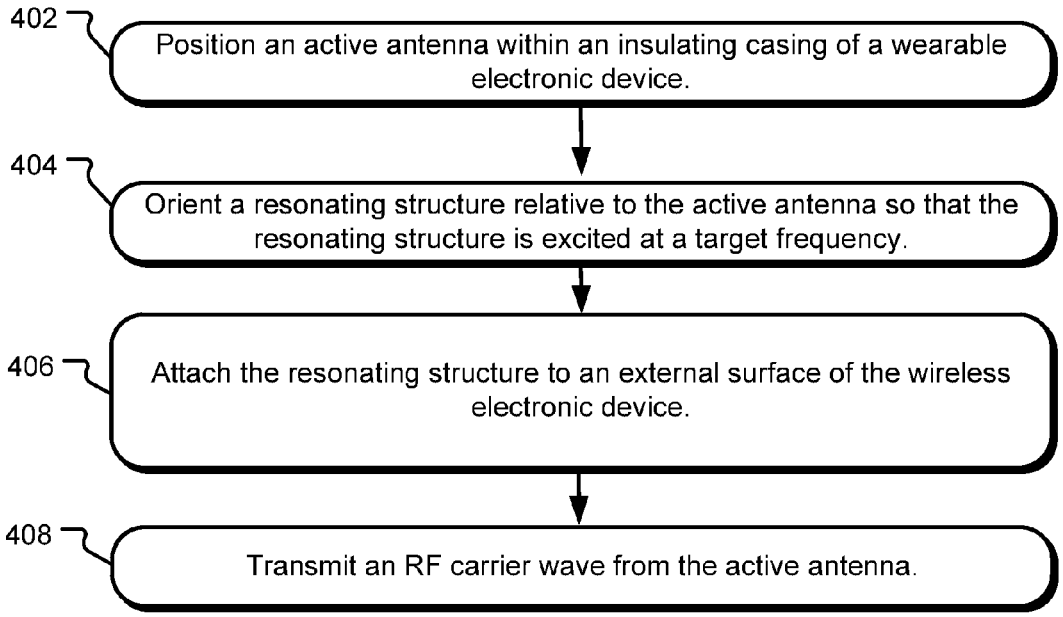
FIG. 4 illustrates example operations for wirelessly transmitting a carrier wave from a wearable electronic device using a parasitic antenna positioned external to a wearable electronic device.

FIG. 4 illustrates example operations 400 for resonating a parasitic antenna of a wearable electronic device to transmit an RF carrier wave. The parasitic antenna forms a portion of an attachment component for attaching the wearable electronic device to a wearer or other body. A positioning operation 402 positions an active antenna, capable of transmitting an RF carrier wave, on or within the wearable electronic device. In one implementation, the active antenna is positioned internal to an insulating outer casing of the wearable electronic device; in another implementation, the active antenna is positioned on an external surface of the wearable electronic device.

An orientation operation 404 orients the parasitic antenna relative to the active antenna so that the parasitic antenna resonates at a target frequency that matches a transmission frequency of the active antenna. In one example operation, the active antenna is a monopole antenna on a PCB internal to the wearable electronic device. In another implementation, a plane of the parasitic antenna (e.g., a plane of a resonating clip) is positioned substantially parallel to the PCB.

An attachment operation 406 attaches the parasitic antenna to an insulating component on an external surface of the wearable electronic device at the position and orientation determined by the positioning operation 402 and the orientation operation 404. A transmission operation 408 transmits an RF carrier wave from the active antenna. The parasitic antenna resonates in the presence of the RF carrier wave, enhancing a transmission power of the wearable electronic device.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. Apparatus comprising:

an active antenna; and an attachment component including a floating portion adapted to resonate in the presence of a carrier wave transmitted by the active antenna, wherein the attachment component is configured to attach the apparatus to a transportable article.

2. The apparatus of claim 1, wherein the attachment component attaches a wearable electronic device to a user.

3. The apparatus of claim 2, wherein the attachment component is a clip and the wearable electronic device is a stylus.

4. The apparatus of claim 1, wherein the active antenna is attached to a printed circuit board that is positioned parallel to a plane of the floating portion of the attachment component.

5. The apparatus of claim 1, wherein the floating portion of the attachment component is a u-shaped wire structure.

6. The apparatus of claim 1, wherein the floating portion of the attachment component includes one or more coiled regions.

7. The apparatus of claim 1, wherein the floating portion of the attachment component is coupled to a resonant network within a wearable electronic device that tunes a resonant frequency of the floating portion.

8. Apparatus comprising:

a stylus including an active antenna and an attachment component, the attachment component including a floating portion adapted to resonate in the presence of a carrier wave transmitted by the active antenna.

9. The apparatus of claim 8, wherein the active antenna is attached to a printed circuit board that is positioned parallel to a plane of the floating portion of the attachment component.

10. The apparatus of claim 8, wherein the active antenna is positioned internal to an outer casing of the stylus.

11. The apparatus of claim 8, wherein the floating portion of the attachment component is a u-shaped wire structure.

12. The apparatus of claim 8, wherein the floating portion of the attachment component includes one or more coiled regions.

13. The apparatus of claim 8, wherein the floating portion of the attachment component is coupled to a resonant network that tunes a resonant frequency of the floating portion.

14. The apparatus of claim 8, wherein the floating portion of the attachment component resonates in a frequency range substantially between 2.4 gigahertz (GHz) and 2.485 GHz.

15. A method comprising:

exciting a floating portion of an attachment component into a state of resonance by transmitting a carrier wave via an active antenna of a wearable electronic device, the attachment component attached to an external surface of the wearable electronic device.

16. The method of claim 15, wherein the floating portion of the attachment component resonates in a frequency range substantially between 2.4 GHz and 2.485 GHz.

17. The method of claim 15, wherein the active antenna is attached to a printed circuit board positioned parallel to a plane of the floating portion.

18. The method of claim 15, wherein the floating portion of the attachment component is a u-shaped wire structure.

19. The method of claim 15, wherein the floating portion of the attachment component includes one or more coiled portions.

20. The method of claim 15, wherein the floating portion of the attachment component is coupled to a resonant network that tunes a resonant frequency of the floating portion.

21. The apparatus of claim 8, wherein the attachment component is configured to attach the stylus to a transportable article.

22. The method of claim 15, wherein the attachment component is configured to attach the wearable electronic device to a transportable article.

* * * * *